US006805236B1

(12) United States Patent
Caruso et al.

(10) Patent No.: US 6,805,236 B1
(45) Date of Patent: Oct. 19, 2004

(54) PROTECTOR FOR KEYLESS ENTRY DEVICE

(76) Inventors: Richard Caruso, 7801 Montgomery Ave., Elkins Park, PA (US) 19027; Richard Bruce Caruso, Jr., 3440 Brae Bourn Dr., Hurtingdon Valley, PA (US) 19006

( * ) Notice: Subject to any disclaimer, the term of this patent is extended or adjusted under 35 U.S.C. 154(b) by 192 days.

(21) Appl. No.: 10/208,623

(22) Filed: Jul. 30, 2002

Related U.S. Application Data

(63) Continuation-in-part of application No. 09/687,803, filed on Oct. 14, 2000, now abandoned.
(60) Provisional application No. 60/223,704, filed on Aug. 8, 2000.

(51) Int. Cl.[7] ..... A45C 11/32
(52) U.S. Cl. ..... 206/37.1; 206/1.5; 206/38.1; 206/320; 220/8; 220/345.3; 220/281
(58) Field of Search ..... 206/37, 37.1, 38, 206/38.1, 39, 39.1, 39.4, 305, 320, 1.5; 220/8, 281, 345.3, 345.4

(56) References Cited

U.S. PATENT DOCUMENTS

| | | | | | |
|---|---|---|---|---|---|
| 1,023,276 | A | * | 4/1912 | Rouse | 206/1.5 |
| 1,293,062 | A | * | 2/1919 | Erdey | 206/1.5 |
| 2,892,537 | A | * | 6/1959 | Schwartz | 206/0.81 |
| 3,018,877 | A | | 1/1962 | Posavil | |
| 3,888,350 | A | * | 6/1975 | Horvath | 206/531 |
| 4,076,117 | A | * | 2/1978 | Wisdom et al. | 206/106 |
| 4,364,488 | A | * | 12/1982 | Anjou | 220/281 |
| 4,401,210 | A | * | 8/1983 | Anjou | 206/1.5 |
| 5,080,222 | A | * | 1/1992 | McNary | 206/1.5 |
| D329,136 | S | * | 9/1992 | Sanchez | D3/208 |
| 5,484,063 | A | | 1/1996 | Cuccio | |
| 5,653,342 | A | | 8/1997 | Eaton | |
| 6,305,540 | B1 | | 10/2001 | Crawford | |

* cited by examiner

*Primary Examiner*—Jila M. Mohandesi
(74) *Attorney, Agent, or Firm*—Daniel E. Kramer

(57) ABSTRACT

A case for holding, protecting, yet allowing easy linear access to a keyless entry device, the case comprising an open ended enclosure with a springlike element provided to frictionally hold the device securely yet slidably within the case.

7 Claims, 2 Drawing Sheets

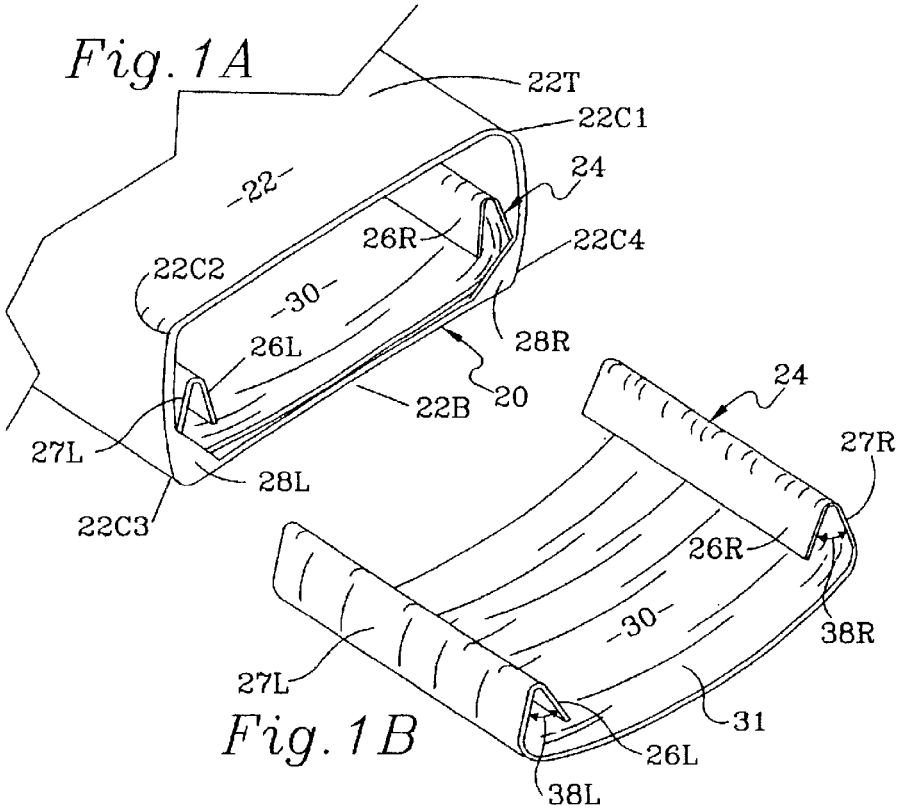
Fig. 1A
Fig. 1B
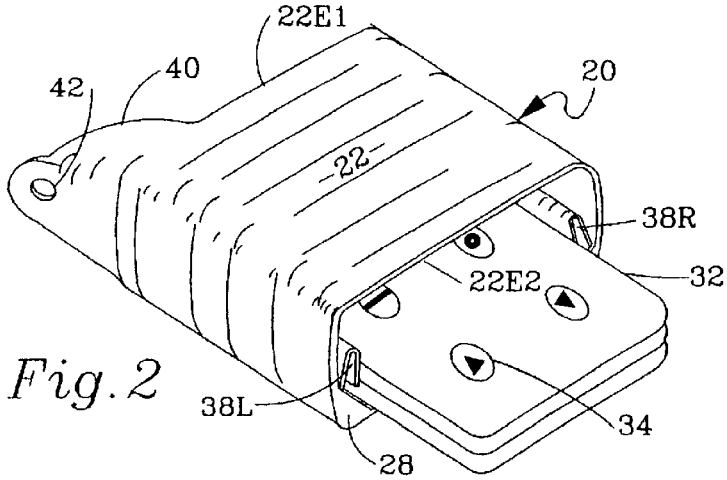
Fig. 2

PROTECTOR FOR KEYLESS ENTRY DEVICE

CONTINUATION IN PART APPLICATION

PRIORITY

Applicants claim priority of and is a continuation-in-part copending Non-Provisional Patent Application filed Oct. 14, 2000 (14 Oct. 2000) and having Ser. No. 09/687,803, now abandoned. Applicants also claim priority of Provisional Patent Application Ser. No. 60/223,704 filed Aug. 8, 2000.

BACKGROUND

1. Field of the Invention

This invention relates to cases for holding and protecting keyless entry devices such as have become common substitutes for keys to open and close garage doors and to gain entry to and to secure locking after exiting from automobiles and other types of passenger vehicles. A serious problem has been found with these keyless devices since even a slight pressure on the opening button can inadvertently cause the auto doors or trunk lid or garage door to be opened or left open as the user is walking away after having deliberately remotely actuated the locking mechanism. Inadvertent unlocking of the auto trunk or garage door is even more egregiously obvious than inadvertent unlocking of the auto doors, since open trunks and garage doors signal their unlocked status to all viewers where, by contrast, passenger and driver side doors remain physically closed even when unlocked.

Therefore, this invention is directed to a case for receiving and securely holding a keyless entry device or transmitter and permitting easy access to its features while, simultaneously sharply limiting the possibility of accidental actuation. The invention performs its protective function by providing a rigid substantially rectangularly shaped tubular sheath open at both ends and having a springlike insert positioned within the sheath. The springlike insert is formed to deflect and impose force on the keyless device as it is inserted into the insert within the sheath. The forces between the keyless device and the insert generate frictional effect between the insert and the keyless device. This frictional effect between the insert and the keyless device acts to resist both entry and removal of the keyless device from the insert and therefore from the sheath within which the insert is positioned. The insertion of the keyless device into the insert causes the insert to deflect and thereby to frictionally secure the device against accidental removal from the insert and from the sheath. Several embodiments of the sheath and the springlike inserts are shown.

2. Prior Art

Applicant's search has disclosed only Des. 427,926 by Lowery of Jul. 11, 2000 titled "Roots toyless Entry and Cover." The FIGS. 1–6 of this design patent appear to disclose a case for a keyless entry device. The case has a hinged cover. Lawrey's FIG. 5 shows the keyless device within the case with the cover open. The cover is seen edge-on at the top of the figure. Thee is no suggestion of any of the features of applicants' structure such as springlike inserts or retainers within a sheath to provide frictional resistance to insertion or removal of the device. This is discussed in the Disclosure Document.

SUMMARY OF THE INVENTION

In this specification the term case refers to the complete assembly which includes an outer sheath and other components. The term keyless device or transmitter refers to a small substantially rectilinear unit The invention comprises an easy access case for a keyless entry device, the case including a sheath, the sheath having slide-in springlike means for frictionally securing the keyless device within the sheath and permitting frictionally resisted straight-line entry and removal of the device.

OBJECTS AND ADVANTAGES

A primary object of the invention is to provide a case for a keyless entry device. The case includes a tubular sheath having a substantially rectangular crossection and springlike means positioned within the sheath for causing the device to be inserted into the sheath against frictional resistance and withdrawn from the sheath against frictional resistance.

A further object is to provide such a case including a sheath having means provided to prevent accidental removal of the springlike means from the sheath.

A further object is to provide such a case including a sheath having both broad sides and narrow sides where the springlike means include means for biasing the keyless device against both a broad side and the narrow sides of the sheath.

A further object is to provide such a case where the sheath is open at both ends thereby allowing the frictionally held keyless device to be pushed out from one end whereby the

BRIEF DESCRIPTION OF THE DRAWINGS

FIG. 1A shows the end part of the tubular sheath having a substantially rectangular crossection with a springlike insert installed. The sheath includes corner stops for preventing accidental removal of the springlike insert from the sheath.

FIG. 1B illustrates the construction and form of one embodiment of the springlike insert.

FIG. 2 shows in isometric view a case of the invention with the springlike insert installed and with the keyless entry device partly inserted into the sheath and corner stops formed in the sheath to prevent inadvertent removal of the insert.

DETAILED DESCRIPTION OF THE INVENTION

Attention will be drawn to other figures where referenced details may be most clearly depicted. All mention of degrees will be degrees of angle.

Figure 4:
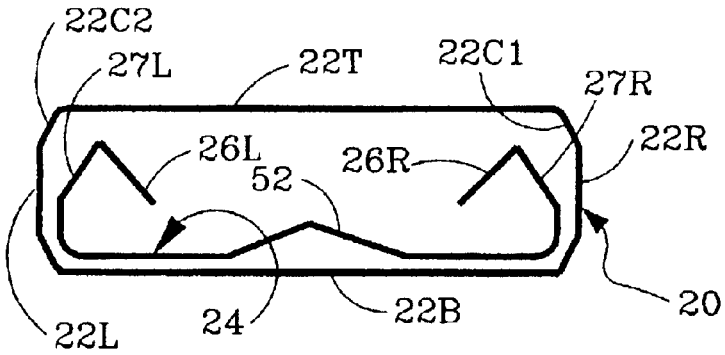
FIG. 4 shows an end view of a case having a sheath with a springlike insert having integral opposing side compression elements and a bottom v-shaped compression element.

FIG. 1A:

FIG. 1A shows an isometric view of the end of a preferred embodiment of a case assembly 20 comprising the invention. Dimensions provided are typical for a keyless device 32 or similar wireless transmitter (FIG. 2). A typical keyless device 32 or transmitter as described herein is a substantially rectilinear unit having a width of 1 inch, a length of 1.75 inches and a depth of 0.5 inches. However, the invention is not restricted to keyless devices or transmitters of this size since the case can be made to fit and provide frictional resistance to the insertion and removal of such devices of any similar size. The keyless device is generally restricted to a size that can readily be clipped to an automobile visor or carried with keys on a keyring. The assembly 20, selected to accommodate device 32, includes a sheath 22 having corner stops 28 and a springlike element or insert 24 for allowing straight line insertion and full or partial straight line removal of the device. The sheath 22, when viewed from the end as in FIG. 4, is in the form of a cylinder or tube having a substantially rectangular crossection. Substantially rectangular means that the tube or cylinder has two opposing or oppositely positioned wider (or broader) sides of approximately equal width joined to two opposing or oppositely positioned narrower sides. As viewed in FIG. 1A the opposing wider sides are identified as 22T and 22B. The wider sides 22T and 22B are joined by opposing narrower sides 22L and 22R (FIG. 4). The junctures between the wider sides and the narrower sides may be sharp or curved. The sides may be planar or curved. FIG. 1A illustrates substantially rectangular sheath 22 having slightly curved wider and narrower sides joined at rounded corners 22C1, 22C2, 22C3 and 22C4. While the preferred embodiment, as shown, has slightly curved wider and narrower sides, the principles of the invention are fulfilled as well by planar sides. The corners may be flat (planar) as shown at 22C2 in FIG. 4 or rounded as in FIG. 1A or square showing only a line interface where the wider and narrower sides join. The sheath is typically formed of metal or of a semirigid plastic sheet or material that is heat formable or extrudable. Typical dimensions for the sheath 22 are ⅝ inch high and 1 9/16 wide with an overall length of 1⅞ inches. The length of the tubular sheath 22 is the distance between the open ends 22E1 and 22E2 identified in FIG. 2. For these overall dimensions the sheath preferably is formed of polypropylene sheet having a thickness of 0.031 inches. If the sheath is formed of aluminum sheet the thickness may be as little as 0.020 inches. The sheath may have a wide variety of dimensions depending on the range of sizes of keyless devices it is intended to accommodate. Larger sheaths may employ thicker materials. A springlike insert 24 is positioned within the sheath 22 for providing frictional resistance to the straight line entry and removal of a keyless device. Springlike insert 24 is described more completely in connection with FIG. 1B. Corner stops 28 are provided integral with sheath 22 to prevent the springlike insert 24 from sliding out of the sheath. Typically the corner stops 28L and R have a substantially triangular shape with sides equal to about 25 percent of the width of the narrow side. All dimensions may be selected and adjusted to suit the particular size of the keyless device. Reference will be made to narrow sides and broad or wide sides of the sheath.

Figure 3:
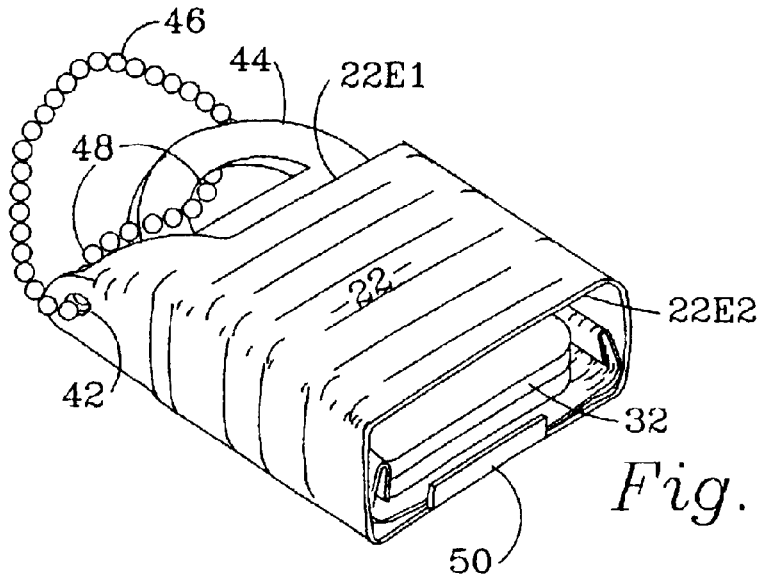
FIG. 3 shows the sheath of FIG. 2 with the keyless device fully inserted and with an inwardly turned tab formed in the sheath to prevent inadvertent removal of the insert.

FIG. 1B:

Springlike insert 24 shown in FIG. 1B. The overall width of the spring like insert 24 is such that, when squeezed at the v-shaped portions it will just slide into sheath 22 and engage corner stops 28L and R (FIGS. 1A and 2). In a typical embodiment of the springlike element 24, the width of the central portion 30 between upwardly turned parts 27 is about 1.25 inches, the width between interior leaves 26R and 26L is about ⅞ inch and the length is about 1⅝ inches, slightly less than the overall length of sheath 22. The insert 24 is formed of a springy plastic sheet such as polypropylene having a thickness between 0.015 and 0.035 inches. The insert can also be made of tempered aluminum having a thickness of about 0.012 inches or spring steel having a thickness of about 0.006 inches. The insert 24 has a central span 30 having a width and a length. The central span 30 is positioned substantially adjacent a sheath wider side 22B. The central span 30 has two opposing edges, a right edge and a left edge, positioned substantially adjacent the sheath narrower sides 22L and 22R. The central span 30 has formed in the left edge of its left longitudinal side a v-shaped structure having an upturned portion 27L connected to the central span 30 and a downward turned portion or leaf 26L connected to its related upturned portion 27L. The central span 30 has formed at the right edge of its right longitudinal side a v-shaped structure having an upturned portion 27R connected to the central span 30 and a downward turned portion or leaf 26R connected to its related upturned portion 27R. The central span 30 of insert 24 therefore serves to join the two v-shaped portions 27L, 26L and 27R, 26R along its length. The width of the central span 30 is the dimension between the two v-shaped elements 27L, 26L and 27R and 26R. There is an open channel 31 formed between the two v-shaped portions 26R, 27R and 26L, 27L. The angles 38L and 38R between parts 27L, 26L and parts 26R, 37R respectively are between 25 and 75 degrees before the keyless device 32 is inserted into channel 31. Since the parts 27L, 26L and the parts 27R and 26R and the angles 38L and 38R are substantially identical, they will be identified further without the L and R designations unless these are required for clarity. The central span 30 may be planar (flat) or formed into a segment of a cylinder (arcuate). Referring to FIGS. 2 and 3 it will be seen that the angles 38L and 38R between the parts 26 and 27 are reduced when the keyless device 32 is inserted into channel 31. This is because the case assembly 20, comprising the sheath 22 and insert 24, is selected based on the size of the keyless device so that the flexing leaves 26 and 27 will be compressed when the keyless device 32 is inserted into the open channel 31, thereby causing the flexing leaves 26 and 27 to exert force on the keyless device whereby friction between the keyless device 32 and the flexing leaves 26, 27 is generated. Typically the angles 38 are between 15 and 35 degrees after the keyless device 32 is inserted into channel 31.

FIG. 2:

In FIG. 2 there is shown an isometric view of one preferred complete embodiment of the invention. In FIG. 2 there is shown the keyless device 32 having buttons or touch pad areas 34. The keyless device 32 is shown inserted part way into the end 22E2 of sheath 22 of the invention. Bearing on the sides of the keyless device 32 are shown the springy v-shaped structures including upturned part 27 and the down turned part 26, together forming springy assemblies having an included angle 38. Corner stops 28L and 28R are shown positioned to prevent the springy insert 24 from slipping out of sheath 22. The opposite end of the sheath 22 identified as 22E2 is open and may be provided with or formed into an extended portion 40 that has positioned therein keychain hole 42. When the user wishes to access a touchpad area 34 of the keyless device she will insert her finger into the open end 22E1 and press the keyless device out of the sheath 22 against the frictional restraint imposed by insert 24, thereby moving the keyless device to its position with respect to the sheath and insert shown in FIG. 2.

FIG. 3:

In FIG. 3 there is shown the completed assembly of the preferred embodiment of the invention. The keyless device 32 is inserted fully into the sheath and held securely by the frictional force applied by springy insert 24. This frictional force is sufficient to hold the keyless device securely in place within sheath 22, but still allows the keyless device 32 to be relatively easily pressed out and partially withdrawn from sheath 22 to a position shown in FIG. 2 to provide access to any of the actuation buttons 34. Upturned lip 50 formed in the material of sheath 22 is provided in the structure of FIG. 3 as a substitute for the corner stops 28 of FIGS. 1A and 2. Stop 50 can also be extended to mechanically prevent accidental removal of device 32. The keyless device 32 may be provided, as part of its structure, with a keychain loop 44. A keychain 46 is routed in a novel route through both the loop 44 of the keyless device 32 and the hole 42 formed in the sheath extended portion 40. With this chain routing it is possible to hang or otherwise fully support the assembly of the keyless device 32 and the sheath 22 from the chain without pulling the keyless device from the sheath 22.

Note that the sheath 22 is open at both ends. Open sheath end 22E2 is visible. Sheath end 22E1 is shown to be open by virtue of loop 44 that is integral with the keyless device extending from sheath end 22E1.

FIG. 4:

FIG. 4 is an end view of case assembly 20 comprising sheath 22 with springlike insert 24. Sheath 22 is cylindrical or tubular in shape with a substantially rectangular crossection as described more fully in connection with FIG. 1A. No corner stops 28 or upturned lip 50 are shown. The springlike insert 24 of FIG. 1B has been modified by the addition of V-shaped configuration 52 formed in the span of insert 24 and positioned approximately midway between the sheath narrower sides 22L and 22R. The purpose of the V-shaped configuration is to apply upward pressure on the bottom of the keyless device, thereby pushing it firmly against the upper inner wall of sheath 22 to ensure proper snug fit of keyless devices made in a variety of sizes within a given case 20.

Preamble to Claims:

From the foregoing description, it can be seen that the present invention comprises a case or construction for containing and protecting a keyless entry device, while at the same time allowing easy access to the device. It will be appreciated by those skilled in the art that changes could be made to the embodiments described in the foregoing description without departing from the broad inventive concepts embodies therein. It is understood, therefore, that this invention is not limited to the particular embodiment or embodiments disclosed, but is intended to cover all modifications which are within the scope and spirit of the invention as defined by the appended claims, its elements, and equivalents thereof as described in the above specification.

We claim:

1. A case for a keyless entry device, the device having a substantially rectilinear shape, the case comprising a tubular sheath open at both ends, the sheath having opposing wide sides and opposing narrow sides and means for allowing but frictionally resisting straight line entry and straight line removal of the keyless device, said resisting means comprising an insert positioned within the sheath, the insert formed of a springlike sheet material, the insert having a central span positioned adjacent a sheath wide side and an edge positioned adjacent each opposing sheath narrow side, the insert having at least one leaf formed in an edge and positioned to deflect and exert force on the keyless device as the device is introduced into the insert means, whereby the straight line entry and removal of the device from the case is frictionally resisted.

2. A case for a keyless device as described in claim 1 further providing that the insert edge in which the leaf is formed, is further formed into a v-shaped part that includes the leaf.

3. A case for a keyless device as described in claim 2 where the insert means includes two v-shaped parts each having a leaf, on formed in each edge of the insert sheet material.

4. A case for a keyless device as described in claim 2 further providing means for preventing accidental removal of the insert, said means comprising a corner stop attached to the sheath and positioned at the intersection of a wide side and a narrow side.

5. A case for a keyless device as described in claim 2 further providing means for preventing accidental removal of the insert, said means comprising an inwardly turned lip formed in a wide side and positioned adjacent the central span of the insert.

6. A case for a keyless device as described in claim 2 further providing that the central span of the insert includes a V-shaped portion positioned approximately midway between the sheath narrower sides.

7. A case for a keyless entry device, the device having a substantially rectilinear shape, the case comprising a tubular sheath open at both ends, the sheath having opposing wide sides and opposing narrow sides and means for allowing but frictionally resisting straight line entry and straight line removal of the keyless device, said resisting means comprising an insert positioned within the sheath, the insert formed of springlike sheet material, the insert having a central span positioned adjacent a sheath wide side and an edge positioned substantially adjacent each opposing sheath narrow aide, the insert having a v-shaped part formed in each edge, each v-shaped part being positioned to deflect and exert force on the keyless device as the device is introduced into the insert means, whereby the straight line entry and removal of the device fray the case is frictionally resisted.

* * * * *